US010181302B2

(12) United States Patent
Chen et al.

(10) Patent No.: US 10,181,302 B2
(45) Date of Patent: Jan. 15, 2019

(54) DRIVE METHOD OF LIQUID CRYSTAL DISPLAY PANEL

(71) Applicant: Shenzhen China Star Optoelectronics Technology Co., Ltd., Shenzhen (CN)

(72) Inventors: Yinhung Chen, Shenzhen (CN); Yu Wu, Shenzhen (CN); Anle Hu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 347 days.

(21) Appl. No.: 15/105,568

(22) PCT Filed: Apr. 8, 2016

(86) PCT No.: PCT/CN2016/078889
§ 371 (c)(1),
(2) Date: Jun. 17, 2016

(87) PCT Pub. No.: WO2017/152460
PCT Pub. Date: Sep. 14, 2017

(65) Prior Publication Data

US 2018/0102100 A1 Apr. 12, 2018

(30) Foreign Application Priority Data

Mar. 11, 2016 (CN) ..... 2016 1 0141537

(51) Int. Cl.
*G09G 3/36* (2006.01)
*G09G 3/20* (2006.01)

(52) U.S. Cl.
CPC ..... *G09G 3/3644* (2013.01); *G09G 3/2014* (2013.01); *G09G 3/2074* (2013.01); *G09G 3/36* (2013.01); *G09G 2310/067* (2013.01)

(58) Field of Classification Search
None
See application file for complete search history.

(56) References Cited

U.S. PATENT DOCUMENTS

2015/0287385 A1* 10/2015 Wu ..... G09G 5/10 345/691
2017/0124976 A1* 5/2017 Chen ..... G06F 3/0412

FOREIGN PATENT DOCUMENTS

CN 101369061 A 2/2009
CN 101866633 A 10/2010

* cited by examiner

*Primary Examiner* — Robin Mishler
(74) *Attorney, Agent, or Firm* — Leong C. Lei

(57) ABSTRACT

The present invention provides a drive method of a liquid crystal display panel, in which the counter (21), and the pulse modulation module (22) are located in the sequence controller (2), and the counter (21) in the sequence controller (2) pluses 1 as the sequence controller (2) outputs the display data of each row, and as the counter (21) in the sequence controller (2) pluses to i×M/N, the pulse modulation module (22) in the sequence controller (2) sends one pulse control signal (CS) to the i+1th gate drive IC correspondingly driving the i+1th pixel display region (Zone(i+1)) to control the i+1th gate drive IC (GD(i+1)) to output the target TFT activation voltage corresponding to the i+1th gate drive IC (GD(i+1)) after the internal calculation and the conversion, and thus the TFT activation voltage can be dynamically adjusted in real time.

14 Claims, 4 Drawing Sheets

DRIVE METHOD OF LIQUID CRYSTAL DISPLAY PANEL

FIELD OF THE INVENTION

The present invention relates to a liquid crystal display field, and more particularly to a drive method of a liquid crystal display panel.

BACKGROUND OF THE INVENTION

The LCD (Liquid Crystal Display) possesses many advantages of being ultra thin, power saved and radiation free. It has been widely utilized in, such as LCD TVs, mobile phones, Personal Digital Assistant (PDA), digital cameras, laptop screens or notebook screens, and dominates the flat panel display field.

Most of the liquid crystal displays on the present market are backlight type liquid crystal displays, which comprise a liquid crystal display panel and a backlight module. The working principle of the liquid crystal display panel is that the Liquid Crystal is injected between the Thin Film Transistor Array Substrate (TFT array substrate) and the Color Filter (CF). The light of backlight module is refracted to generate images by applying driving voltages to the two substrates for controlling the rotations of the liquid crystal molecules.

The liquid crystal display panel comprises a plurality of sub pixels aligned in array. Each pixel is electrically coupled to one thin film transistor (TFT). The Gate of the TFT is coupled to a horizontal gate scan line, and Source of the TFT is coupled to a vertical data line, and the Drain is coupled to the pixel electrode. The enough voltage is applied to the gate scan line with the Gate driver IC, and all the TFTs electrically coupled to the gate scan line are activated. Thus, the signal voltage on the data line can be written into the pixels to control the transmittances of the liquid crystals and to realize the display result.

With the development of the display technology, the dimension of the liquid crystal panel becomes larger and larger, and the resolution gets higher and higher. Generally, the liquid crystal display panel relies on the Pulse-Width Modulation (PWM) IC to produce a constant TFT activation voltage (VGH) for the gate driver IC to drive the TFTs in the sub pixels of respective rows, and then it is possible to charge the sub pixels. As shown in FIG. 1, the drive system of the liquid crystal display panel according to prior art comprises a liquid crystal display panel 100, a plurality of gate driver IC GD10, GD20, GD30, and etc. The constant TFT activation voltage VGH is generated by the PWM IC on the Printed Circuit Board Assembly (PCBA), and is transmitted to the respective gate driver ICs through the Wire On Array (WOA) located on the TFT array substrate. Because the WOA is thinner and the resistance is larger, the TFT activation voltage VGH will decay, and the TFT activation voltages VGH which the different gate driver ICs actually receive have larger difference to lead to that the charge times of the different pixel display regions corresponded with the different gate driver ICs are different. The Horizontal block (H Block) phenomenon commonly appears between the adjacent pixel display regions. Namely, there is the obvious horizontal border between the adjacent pixel display regions, which severely influences the watch experience and results in the quality descend of the liquid crystal display panel.

SUMMARY OF THE INVENTION

An objective of the present invention is to provide a drive method of a liquid crystal display panel, which can adjust the TFT activation voltage in time so that the TFT activation voltages, which the respective gate drive ICs actually receive are consistent, and thus the charge times of the various pixel display regions are equal to eliminate the horizontal block issue and to raise the quality of the liquid crystal display panel.

For realizing the aforesaid objective, the present invention provides a drive method of a liquid crystal display panel, comprising steps of:

step 1, providing a drive system of the liquid crystal display panel;

the drive system of the liquid crystal display panel comprises:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs which are cascade coupled are at least located at one side of the liquid crystal display panel, and each gate drive IC is in charge of driving the pixels of M/N rows in one pixel display region;

and a sequence controller electrically coupled to the respective gate drive ICs;

the sequence controller comprises a counter, and a pulse modulation module electrically coupled to the counter;

step 2, providing a start signal to the N gate drive ICs which are cascade coupled with the sequence controller, and providing an initial TFT activation voltage to the first gate drive IC correspondingly driving the first pixel display region, and meanwhile, starting to output display data to the liquid crystal display panel row by row, and the counter in the sequence controller pluses 1 as outputting the display data of each row;

step 3, i is set to be a positive integer, and $1 \leq N$, and as the counter in the sequence controller pluses to $i \times M/N$, the pulse modulation module in the sequence controller sends one pulse control signal to the i+1th gate drive IC correspondingly driving the i+1th pixel display region to control the i+1th gate drive IC to output a target TFT activation voltage corresponding to the i+1th gate drive IC after an internal calculation and a conversion;

step 4, resetting the counter to zero as the counter inside the sequence controller pluses to M.

In the step 3, an execution procedure of controlling the i+1th gate drive IC to output the target TFT activation voltage corresponding to the i+1th gate drive IC after the internal calculation and the conversion is: generating one high frequency detection signal inside the i+1th gate drive IC, and as starting from that the i+1th gate drive IC detects a rising edge of the start signal to detecting a falling edge of the start signal, the high frequency detection signal implements several digital conversions to a voltage level of the pulse control signal, and the i+1th gate drive IC outputs the corresponding target TFT activation voltage according to results of the digital conversions.

As the high frequency detection signal implements several digital conversions to the voltage level of the pulse control signal, a high voltage level of the pulse control signal is converted in to a logic digital 1, and a low voltage level of the pulse control signal is converted into a logic digital 0.

A number of implementing several digital conversions to the voltage level of the pulse control signal with the high frequency detection signal is set to be a, and a is a positive integer larger than 1, and $2a>N$ is met.

Respective pulse control signals sent to the respective gate drive ICs by the pulse modulation module are different.

High frequency detection signals generated inside the respective gate drive ICs are the same.

N gate drive ICs are also located at the other side of the liquid crystal display panel, and pixels of M/N rows of one pixel display region are commonly driven by the two gate drive ICs at the two sides of the pixel display region.

The TFT activation voltage of the i+1th gate drive IC is larger than the TFT activation voltage of the ith gate drive IC; the TFT activation voltages, which the respective gate drive ICs finally and actually receive are the same.

The present invention further provides a drive method of a liquid crystal display panel, comprising steps of:

step 1, providing a drive system of the liquid crystal display panel;

the drive system of the liquid crystal display panel comprises:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs which are cascade coupled are at least located at one side of the liquid crystal display panel, and each gate drive IC is in charge of driving the pixels of M/N rows in one pixel display region;

and a sequence controller electrically coupled to the respective gate drive ICs;

the sequence controller comprises a counter, and a pulse modulation module electrically coupled to the counter;

step 2, providing a start signal to the N gate drive ICs which are cascade coupled with the sequence controller, and providing an initial TFT activation voltage to the first gate drive IC correspondingly driving the first pixel display region, and meanwhile, starting to output display data to the liquid crystal display panel row by row, and the counter in the sequence controller pluses 1 as outputting the display data of each row;

step 3, i is set to be a positive integer, and $1 \leq i < N$, and as the counter in the sequence controller pluses to $i \times M/N$, the pulse modulation module in the sequence controller sends one pulse control signal to the i+1th gate drive IC correspondingly driving the i+1th pixel display region to control the i+1th gate drive IC to output a target TFT activation voltage corresponding to the i+1th gate drive IC after an internal calculation and a conversion;

step 4, resetting the counter to zero as the counter inside the sequence controller pluses to M;

wherein in the step 3, an execution procedure of controlling the i+1th gate drive IC to output the target TFT activation voltage corresponding to the i+1th gate drive IC after the internal calculation and the conversion is: generating one high frequency detection signal inside the i+1th gate drive IC, and as starting from that the i+1th gate drive IC detects a rising edge of the start signal to detecting a falling edge of the start signal, the high frequency detection signal implements several digital conversions to a voltage level of the pulse control signal, and the i+1th gate drive IC outputs the corresponding target TFT activation voltage according to results of the digital conversions;

wherein the TFT activation voltage of the i+1th gate drive IC is larger than the TFT activation voltage of the ith gate drive IC; the TFT activation voltages, which the respective gate drive ICs finally and actually receive are the same.

The benefits of the present invention are: in the drive method of the liquid crystal display panel provided by the present invention, the counter, and the pulse modulation module electrically coupled to the counter are located in the sequence controller, and the counter in the sequence controller pluses 1 as the sequence controller outputs the display data of each row, and as the counter in the sequence controller pluses to $i \times M/N$, the pulse modulation module in the sequence controller sends one pulse control signal to the i+1th gate drive IC correspondingly driving the i+1th pixel display region to control the i+1th gate drive IC to output the target TFT activation voltage corresponding to the i+1th gate drive IC after the internal calculation and the conversion, and thus the TFT activation voltage can be dynamically adjusted in real time so that the TFT activation voltages, which the respective gate drive ICs actually receive are consistent, and thus the charge times of the various pixel display regions are equal to eliminate the horizontal block issue and to raise the quality of the liquid crystal display panel.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
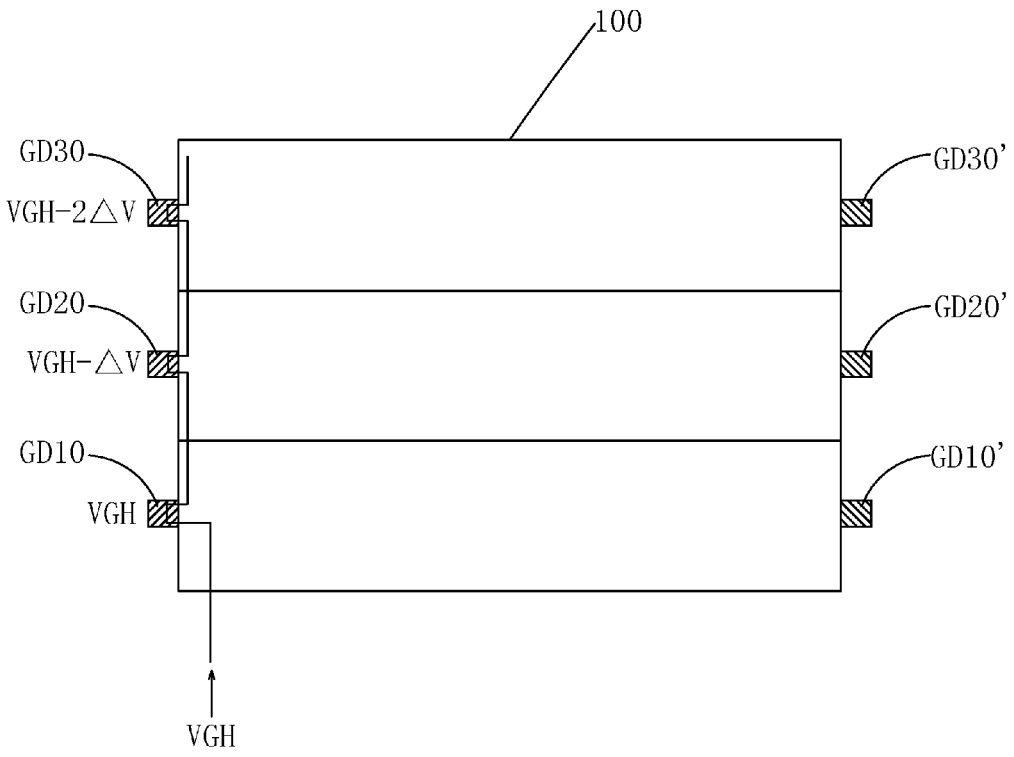
FIG. 1 is a diagram of a drive system structure of a liquid crystal display panel according to prior art.
Figure 2:
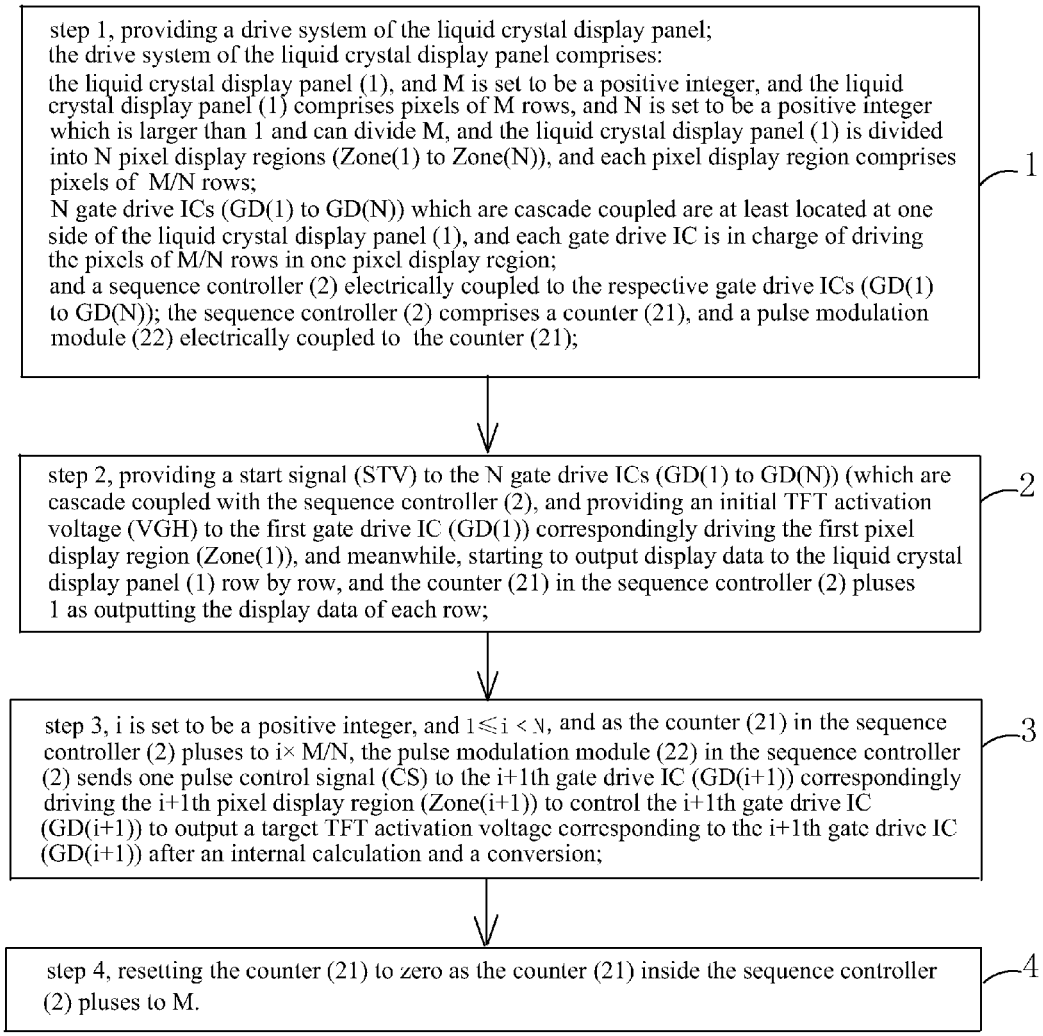
FIG. 2 is a flowchart of a drive method of a liquid crystal display panel according to the present invention.
Figure 3:
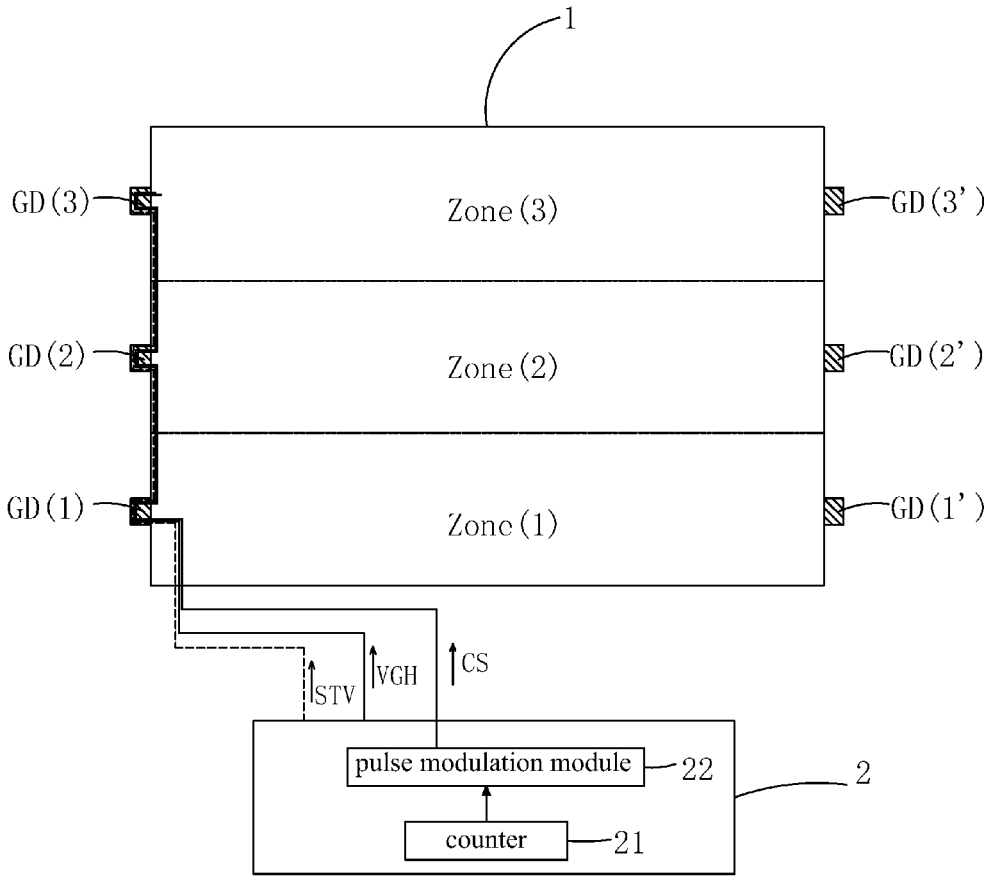
FIG. 3 is a diagram of a drive system of a liquid crystal display panel in the drive method of the liquid crystal display panel according to the present invention.
Figure 4:
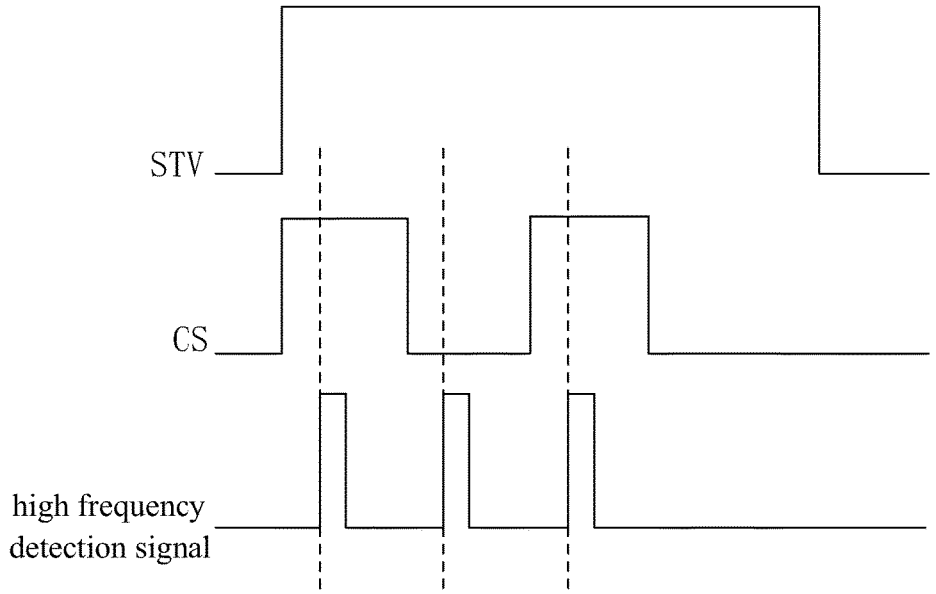
FIG. 4 is a diagram that the high frequency detection signal converts the voltage level of the control signal in the driving method of the liquid crystal display panel according to the present invention.
Figure 5:
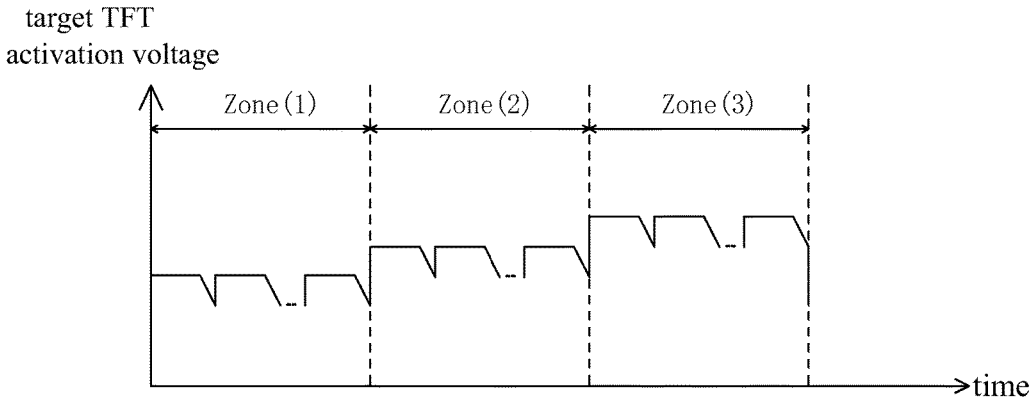
FIG. 5 is a waveform diagram of the target TFT activation voltages of the respective gate drive ICs in the driving method of the liquid crystal display panel according to the present invention.

Please refer to FIG. 2 in combination with FIG. 3 to FIG. 5, the present invention provides a drive method of a liquid crystal display panel, comprising steps of:

step 1, providing a drive system of the liquid crystal display panel.

As shown in FIG. 3, the drive system of the liquid crystal display panel comprises:

the liquid crystal display panel 1, and M is set to be a positive integer, and the liquid crystal display panel 1 comprises pixels of M rows, and N is set to be a positive integer which is larger than 1 and can divide M, and the liquid crystal display panel 1 is divided into N pixel display regions Zone(1) to Zone(N), and each pixel display region comprises pixels of M/N rows;

N gate drive ICs GD(1) to GD(N) which are cascade coupled are at least located at one side of the liquid crystal display panel 1, and each gate drive IC is in charge of driving the pixels of M/N rows in one pixel display region;

and a sequence controller 2 electrically coupled to the respective gate drive ICs GD(1) to GD(N); the sequence controller 2 comprises a counter 21, and a pulse modulation module 22 electrically coupled to the counter 21.

It is illustrated that the resolution of the liquid crystal display panel 1 is 3840×2160. The liquid crystal display panel 1 has pixels of 2160 rows, and the liquid crystal display panel 1 is divided into 3 pixel display regions Zone(1) to Zone(3), and each pixel display region comprises pixels of 720 rows. 3 gate drive ICs GD(1) to GD(3) are at least located at one side of the liquid crystal display panel 1, and each gate drive IC is in charge of driving the pixels of 720 rows in one pixel display region. Namely, the first pixel display region Zone(1) is merely driven by the first gate drive IC GD(1), and the second pixel display region Zone(2) is merely driven by the second gate drive IC GD(2), and the third pixel display region Zone(3) is merely driven by the third gate drive IC GD(3), which is applicable for the situation of single side drive of the liquid crystal display panel; certainly, 3 gate drive ICs GD(1') to GD(3') also can be located at the other side of the liquid crystal display panel 1, and pixels of 720 rows of one pixel display region are commonly driven by the two gate drive ICs at the two sides of the pixel display region. Namely, the first pixel display region Zone(1) is commonly driven by the two gate drive ICs GD(1) and GD(1') at the two sides, and the second pixel display region Zone(2) is commonly driven by the two gate drive ICs GD(2) and GD(2') at the two sides, and the third pixel display region Zone(3) is commonly driven by the two gate drive ICs GD(3) and GD(3') at the two sides, which is applicable for the situation of double sides drive of the liquid crystal display panel.

step 2, providing a start signal STV to the N gate drive ICs GD(1) to GD(N) (or GD(1) to GD(N) and GD(1') to GD(N')) which are cascade coupled with the sequence controller 2, and providing an initial TFT activation voltage VGH to the first gate drive IC GD(1) (or GD(1) and GD(1')) correspondingly driving the first pixel display region Zone(1), and meanwhile, starting to output display data to the liquid crystal display panel 1 row by row, and the counter 21 in the sequence controller 2 pluses 1 as outputting the display data of each row.

In the step 2, the first gate drive IC GD(1) (or GD(1) and GD(1')) utilizes the initial TFT activation voltage provided by the sequence controller 2 to drive the pixels of the respective rows in the first pixel display region Zone(1) for charging.

step 3, i is set to be a positive integer, and $1 \leq i < N$, and as the counter 21 in the sequence controller 2 pluses to $i \times M/N$, the pulse modulation module 22 in the sequence controller 2 sends one pulse control signal CS to the i+1th gate drive IC GD(i+1) (or GD(i+1) and GD(i+1')) correspondingly driving the i+1th pixel display region Zone(i+1) to control the i+1th gate drive IC GD(i+1) (or GD(i+1) and GD(i+1')) to output a target TFT activation voltage corresponding to the i+1th gate drive IC GD(i+1) (or GD(i+1) and GD(i+1')) after an internal calculation and a conversion.

Specifically, with combination of FIG. 3 and FIG. 4, and in the step 3, an execution procedure that the pulse control signal CS controls the i+1th gate drive IC GD(i+1) (or GD(i+1) and GD(i+1')) to output the target TFT activation voltage corresponding to the i+1th gate drive IC GD(i+1) (or GD(i+1) and GD(i+1')) after the internal calculation and the conversion is: generating one high frequency detection signal inside the i+1th gate drive IC GD(i+1) (or GD(i+1) and GD(i+1')), and as starting from that the i+1th gate drive IC GD(i+1) (or GD(i+1) and GD(i+1')) detects a rising edge of the start signal SW to detecting a falling edge of the start signal STV, the high frequency detection signal implements several digital conversions to a voltage level of the pulse control signal CS, and the i+1th gate drive IC GD(i+1) (or GD(i+1) and GD(i+1')) outputs the corresponding target TFT activation voltage according to results of the digital conversions.

Furthermore, as the high frequency detection signal implements several digital conversions to the voltage level of the pulse control signal CS, a high voltage level of the pulse control signal CS is converted in to a logic digital 1, and a low voltage level of the pulse control signal CS is converted into a logic digital 0. What is shown in FIG. 4 is illustrated, the high frequency detection signal implements 3 digital conversions to the voltage level of the pulse control signal CS, and the rising edge of the first pulse of the high frequency detection signal corresponds to the high voltage level of the control signal CS, and the rising edge of the second pulse of the high frequency detection signal corresponds to the low voltage level of the control signal CS, and the rising edge of the third pulse of the high frequency detection signal corresponds to the high voltage level of the control signal CS, and the result of the digital conversion is 101.

Significantly, respective pulse control signals CS sent to the respective gate drive ICs GD(2) to GD(N) (or GD(2) to GD(N) and GD(2') to GD(N')) by the pulse modulation module 22 are different (mainly the lasting durations of the high, low voltage levels are different) but high frequency detection signals generated inside the respective gate drive ICs GD(2) to GD(N) (or GD(2) to GD(N) and GD(2') to GD(N')) are the same. Thus, the digital conversion that the high frequency implements to the voltage levels of the pulse control signals CS can have the different results. Still, it is illustrated that the high frequency detection signal implements 3 digital conversions to the voltage level of the pulse control signal CS, the eight results of digital conversions 000, 001, 010, 011, 100, 101, 110, 111 can be obtained. The respective gate drive ICs GD(2) to GD(N) (or GD(2) to GD(N) and GD(2') to GD(N')) can output the various target TFT activation voltages corresponding to the results of the respective digital conversions according to the various results of the respective digital conversions. Besides, a number of implementing several digital conversions to the voltage level of the pulse control signal CS with the high frequency detection signal is set to be a, and a is a positive integer larger than 1, and $2a > N$ is met to ensure that the gate drive IC for driving each pixel display region can output a target TFT activation voltage which is different from other gate drive ICs.

That the respective pulse control signals sent by the pulse modulation module 22 to the respective gate drive ICs GD(2) to GD(N) (or GD(2) to GD(N) and GD(2') to GD(N')) are different is based on: under the situation of providing the initial TFT activation voltage to all the respective gate drive ICs of the same liquid crystal display panel 1, the TFT activation voltage decay amplitude between the two adjacent gate drive ICs is obtained by practical measurement. Because the decay of the TFT activation voltage on the wiring is linear, the increased amplitude of the target activation voltage should be linear, too. By setting the internal register of the sequence controller 2, the target TFT activation voltages respectively corresponded with the digital conversion results of the two adjacent pulse control signals CS sent by the pulse modulation module 22 is set to be one TFT activation voltage decay amplitude.

Still, it is illustrated that the resolution of the liquid crystal display panel 1 is 3840×2160. As the counter 21 pluses to 720, it means that the first pixel display region Zone(1), of which the gate drive ICs GD(1) and GD(1') are in charge, has already been charged, and the pulse modulation module 22 in the sequence controller 2 sends one pulse control signal CS to the second gate drive ICs GD(2) and GD(2') correspondingly driving the second pixel display region Zone(2), and the second gate drive ICs GD(2) and GD(2') generate a high frequency detection signal inside. As starting from detecting the rising edge of the start signal STV to detecting the falling edge of the start signal STV, the high frequency detection signal implements several digital conversions to the voltage level of the pulse control signal CS, and the second gate drive ICs GD(2) and GD(2') output the corresponding target TFT activation voltage according to the results of the digital conversions;

Similarly, as the counter 31 pluses to 1440, it means that the second pixel display region Zone(2), of which the gate drive ICs GD(2) and GD(2') are in charge, has already been charged, and the pulse modulation module 22 in the sequence controller 2 sends one pulse control signal CS, which is different from the previous pulse control signal to the third gate drive ICs GD(3) and GD(3') correspondingly driving the second pixel display region Zone(3), and the third gate drive ICs GD(3) and GD(3') generate a high frequency detection signal inside which is the same as the previous high frequency detection signal. As starting from detecting the rising edge of the start signal STV to detecting the falling edge of the start signal STV, the high frequency detection signal implements several digital conversions to the voltage level of the pulse control signal CS, and the third gate drive ICs GD(3) and GD(3') output the corresponding target TFT activation voltage according to the results of the digital conversions.

and so on.

step 4, resetting the counter 21 to zero as the counter 21 inside the sequence controller 2 pluses to M.

Still, it is illustrated that the resolution of the liquid crystal display panel 1 is 3840×2160. As the counter 21 pluses to 2160, it means that the third pixel display region Zone(3), of which the gate drive ICs GD(3) and GD(3') are in charge, has already been charged, and the counter 21 is reset to zero to enter the drive and display of the next frame of image.

As shown in FIG. 5, the target TFT activation voltage of the i+1th gate drive ICs GD(i+1) (or GD(i+1) and GD(i+1')) correspondingly driving the i+1th pixel display region Zone (i+1) is larger than the target TFT activation voltage of the ith gate drive ICs GD(i) (or GD(i) and GD(i')) correspondingly driving the ith pixel display region Zone(i). However, liner decay exists as the TFT activation voltage is transmitted on the wiring, the TFT activation voltages, which the respective gate drive ICs GD(1) to GD(N) (or GD(1) to GD(N) and GD(1') to GD(N')) finally and actually receive are the same, which realizes the adjustment of the TFT activation voltage in time so that the charge times of the various pixel display regions are equal to eliminate the horizontal block issue and to raise the quality of the liquid crystal display panel.

In conclusion, in the drive method of the liquid crystal display panel according to the present invention, the counter, and the pulse modulation module electrically coupled to the counter are located in the sequence controller, and the counter in the sequence controller pluses 1 as the sequence controller outputs the display data of each row, and as the counter in the sequence controller pluses to i×M/N, the pulse modulation module in the sequence controller sends one pulse control signal to the i+1th gate drive IC correspondingly driving the i+1th pixel display region to control the i+1th gate drive IC to output the target TFT activation voltage corresponding to the i+1th gate drive IC after the internal calculation and the conversion, and thus the TFT activation voltage can be dynamically adjusted in real time so that the TFT activation voltages, which the respective gate drive ICs actually receive are consistent, and thus the charge times of the various pixel display regions are equal to eliminate the horizontal block issue and to raise the quality of the liquid crystal display panel.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A drive method of a liquid crystal display panel, comprising steps of:

step 1, providing a drive system of the liquid crystal display panel;

the drive system of the liquid crystal display panel comprises:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs which are cascade coupled are at least located at one side of the liquid crystal display panel, and each gate drive IC is in charge of driving the pixels of M/N rows in one pixel display region;

and a sequence controller electrically coupled to the respective gate drive ICs;

the sequence controller comprises a counter, and a pulse modulation module electrically coupled to the counter;

step 2, providing a start signal to the N gate drive ICs which are cascade coupled with the sequence controller, and providing an initial TFT activation voltage to the first gate drive IC correspondingly driving the first pixel display region, and meanwhile, starting to output display data to the liquid crystal display panel row by row, and the counter in the sequence controller pluses 1 as outputting the display data of each row;

step 3, i is set to be a positive integer, and $1 \leq i < N$, and as the counter in the sequence controller pluses to i×M/N, the pulse modulation module in the sequence controller sends one pulse control signal to the i+1th gate drive IC correspondingly driving the i+1th pixel display region to control the i+1th gate drive IC to output a target TFT activation voltage corresponding to the i+1th gate drive IC after an internal calculation and a conversion;

step 4, resetting the counter to zero as the counter inside the sequence controller pluses to M;

wherein in the step 3, an execution procedure of controlling the i+1th gate drive IC to output the target TFT activation voltage corresponding to the i+1th gate drive IC after the internal calculation and the conversion is: generating one high frequency detection signal inside the i+1th gate drive IC, and as starting from that the i+1th gate drive IC detects a rising edge of the start signal to detecting a falling edge of the start signal, the high frequency detection signal implements several digital conversions to a voltage level of the pulse control signal, and the i+1th gate drive IC outputs the corresponding target TFT activation voltage according to results of the digital conversions.

2. The drive method of the liquid crystal display panel according to claim 1, wherein as the high frequency detection signal implements several digital conversions to the voltage level of the pulse control signal, a high voltage level of the pulse control signal is converted in to a logic digital 1, and a low voltage level of the pulse control signal is converted into a logic digital 0.

3. The drive method of the liquid crystal display panel according to claim 1, wherein a number of implementing several digital conversions to the voltage level of the pulse control signal with the high frequency detection signal is set to be a, and a is a positive integer larger than 1, and 2a>N is met.

4. The drive method of the liquid crystal display panel according to claim 1, wherein respective pulse control signals sent to the respective gate drive ICs by the pulse modulation module are different.

5. The drive method of the liquid crystal display panel according to claim 4, wherein high frequency detection signals generated inside the respective gate drive ICs are the same.

6. The drive method of the liquid crystal display panel according to claim 1, wherein N gate drive ICs are also located at the other side of the liquid crystal display panel, and pixels of M/N rows of one pixel display region are commonly driven by the two gate drive ICs at the two sides of the pixel display region.

7. The drive method of the liquid crystal display panel according to claim 1, wherein the TFT activation voltage of the i+1th gate drive IC is larger than the TFT activation voltage of the ith gate drive IC; the TFT activation voltages, which the respective gate drive ICs finally and actually receive are the same.

8. A drive method of a liquid crystal display panel, comprising steps of:

step 1, providing a drive system of the liquid crystal display panel;

the drive system of the liquid crystal display panel comprises:

the liquid crystal display panel, and M is set to be a positive integer, and the liquid crystal display panel comprises pixels of M rows, and N is set to be a positive integer which is larger than 1 and can divide M, and the liquid crystal display panel is divided into N pixel display regions, and each pixel display region comprises pixels of M/N rows;

N gate drive ICs which are cascade coupled are at least located at one side of the liquid crystal display panel, and each gate drive IC is in charge of driving the pixels of M/N rows in one pixel display region;

and a sequence controller electrically coupled to the respective gate drive ICs;

the sequence controller comprises a counter, and a pulse modulation module electrically coupled to the counter;

step 2, providing a start signal to the N gate drive ICs which are cascade coupled with the sequence controller, and providing an initial TFT activation voltage to the first gate drive IC correspondingly driving the first pixel display region, and meanwhile, starting to output display data to the liquid crystal display panel row by row, and the counter in the sequence controller pluses 1 as outputting the display data of each row;

step 3, i is set to be a positive integer, and 1≤i<N, and as the counter in the sequence controller pluses to i×M/N, the pulse modulation module in the sequence controller sends one pulse control signal to the i+1th gate drive IC correspondingly driving the i+1th pixel display region to control the i+1th gate drive IC to output a target TFT activation voltage corresponding to the i+1th gate drive IC after an internal calculation and a conversion;

step 4, resetting the counter to zero as the counter inside the sequence controller pluses to M;

wherein in the step 3, an execution procedure of controlling the i+1th gate drive IC to output the target TFT activation voltage corresponding to the i+1th gate drive IC after the internal calculation and the conversion is: generating one high frequency detection signal inside the i+1th gate drive IC, and as starting from that the i+1th gate drive IC detects a rising edge of the start signal to detecting a falling edge of the start signal, the high frequency detection signal implements several digital conversions to a voltage level of the pulse control signal, and the i+1th gate drive IC outputs the corresponding target TFT activation voltage according to results of the digital conversions;

wherein the TFT activation voltage of the i+1th gate drive IC is larger than the TFT activation voltage of the ith gate drive IC; the TFT activation voltages, which the respective gate drive ICs finally and actually receive are the same.

9. The drive method of the liquid crystal display panel according to claim 8, wherein as the high frequency detection signal implements several digital conversions to the voltage level of the pulse control signal, a high voltage level of the pulse control signal is converted in to a logic digital 1, and a low voltage level of the pulse control signal is converted into a logic digital 0.

10. The drive method of the liquid crystal display panel according to claim 8, wherein a number of implementing several digital conversions to the voltage level of the pulse control signal with the high frequency detection signal is set to be a, and a is a positive integer larger than 1, and 2a>N is met.

11. The drive method of the liquid crystal display panel according to claim 8, wherein respective pulse control signals sent to the respective gate drive ICs by the pulse modulation module are different.

12. The drive method of the liquid crystal display panel according to claim 11, wherein high frequency detection signals generated inside the respective gate drive ICs are the same.

13. The drive method of the liquid crystal display panel according to claim 8, wherein N gate drive ICs are also located at the other side of the liquid crystal display panel, and pixels of M/N rows of one pixel display region are commonly driven by the two gate drive ICs at the two sides of the pixel display region.

14. The drive method of the liquid crystal display panel according to claim 8, wherein the TFT activation voltage of the i+1th gate drive IC is larger than the TFT activation voltage of the ith gate drive IC; the TFT activation voltages, which the respective gate drive ICs finally and actually receive are the same.

* * * * *